United States Patent [19]

Discenza

[11] 4,291,211

[45] Sep. 22, 1981

[54] ILLUMINATED TOGGLE SWITCH

[75] Inventor: Frank J. Discenza, Rocky Hill, Conn.

[73] Assignee: Carlingswitch, Inc., West Hartford, Conn.

[21] Appl. No.: 99,612

[22] Filed: Dec. 3, 1979

[51] Int. Cl.[3] ..... H01H 9/16

[52] U.S. Cl. ..... 200/311; 200/315

[58] Field of Search ..... 200/311, 315

[56] References Cited

U.S. PATENT DOCUMENTS 4,082,934 4/1978 Piber ..... 200/315

4,104,981 8/1978 Ono et al. ..... 200/315

FOREIGN PATENT DOCUMENTS 487946 11/1952 Canada ..... 200/311

*Primary Examiner*—Willis Little

*Attorney, Agent, or Firm*—McCormick, Paulding & Huber

[57] ABSTRACT

The toggle is of transparent plastic so that a lamp inside the switch case can illuminate the inner end of the toggle and thereby light up that portion of the toggle projecting outwardly of the case. Two colors are possible, to reflect the on/off condition of the switch. A transparent red colored plastic actuator is provided at the inner end of the toggle to contrast with the clear plastic toggle itself, and light from the lamp, in one position of the toggle must first pass through this red actuator prior to reaching the toggle, thereby making the toggle appear red. In the other toggle position, the light from the lamp strikes the inner end of the clear plastic toggle directly without first passing through the actuator, thereby giving the toggle a clear light. In an alternative embodiment, the clear plastic toggle has its inner end portion fitted with a green plastic sleeve, which is also transparent, to provide green and red contrasting colors for the two conditions of the switch corresponding to two alternative toggle positions.

5 Claims, 6 Drawing Figures

FIG. 1
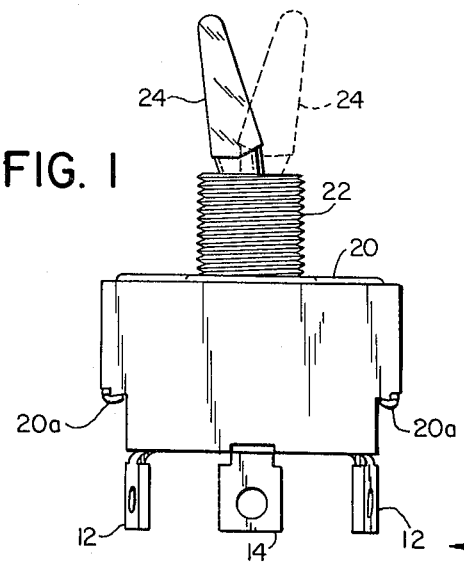
FIG. 2
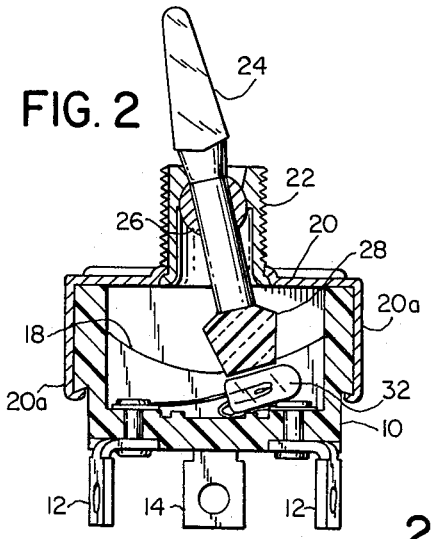
FIG. 3
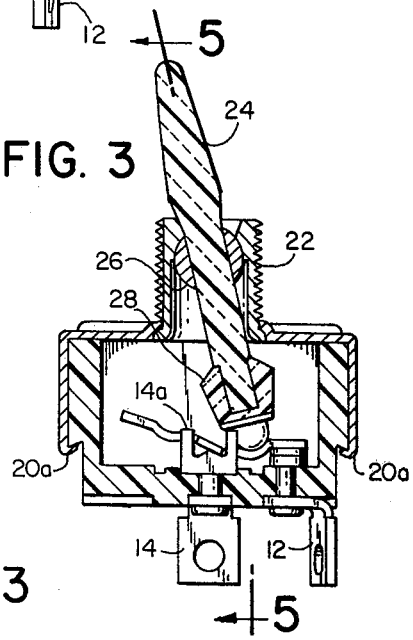
FIG. 4
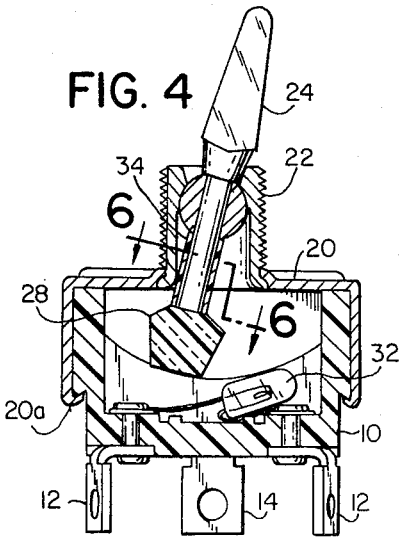
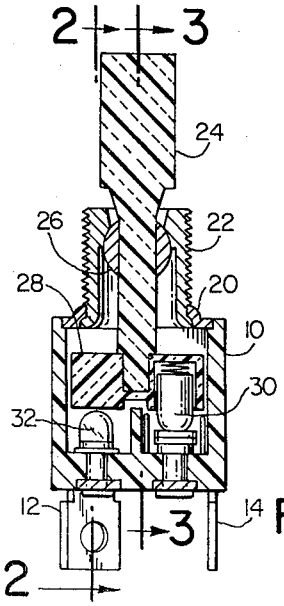
FIG. 5
FIG. 6
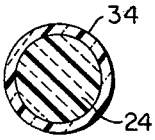

ILLUMINATED TOGGLE SWITCH

BACKGROUND OF THE INVENTION

This invention relates generally to electric toggle switches, and deals more particularly with a toggle switch of the type having a plastic toggle which is pivotally retained in the switch case by a ball collar staked thereto as shown U.S. Pat. No. 3,867,604.

A lamp is provided inside the switch case to illuminate the clear plastic toggle while the switch is in one position, and to illuminate the toggle through a window provided at the inner end of the toggle when the switch is in its alternative position, providing contrasting colors for different switch conditions.

SUMMARY OF THE INVENTION

An electric switch of the toggle type is provided with an opaque case, and with an opaque cover for the case. A toggle element provided in the cover, and adapted to operate a movable switch contact element in the two position toggle switch. The toggle element is preferably of clear plastic, and includes a ball collar staked to the toggle shaft, that is to the inner end of the toggle such that the toggle is pivotally received in the switch case cover. An actuator is provided at the inner end of the toggle or operating lever and includes plunger means for engaging the movable contact element in response to pivotal, operating movement, of the toggle. This actuator restricts the toggle to pivotal motion in one plane only, and the actuator is also made of transparent plastic, preferably colored red to provide a contrast to the transparent clear plastic of the toggle itself. Finally, a lamp is provided inside the switch case so as to illuminate the actuator at the end of the toggle when the switch is in one position, and to thereby illuminate the projecting portion of the toggle with the red color of the plastic actuator. In its alternative position the toggle is arranged so that the actuator is spaced from the light source or lamp, and in this condition of the switch light from the lamp is adapted to illuminate the toggle directly in order to provide a contrasting clear color for the toggle.

In an alternative embodiment of the present invention the inner shank or shaft portion of the toggle is fitted with a transparent plastic sleeve of contrasting color to the actuator such that in the alternative position for the toggle, light from the lamp is adapted to strike the sleeve on the toggle shank, and to provide this particular color to the projecting end portion of the clear plastic toggle element.

BRIEF DESCRIPTION OF THE DRAWINGS

FIG. 1 is an elevational view of an electric toggle switch constructed in accordance with the present invention, and shows the toggle in broken lines in an alternative position.

FIG. 2 is a vertical sectional view taken through the toggle switch of FIG. 1 in contrast to FIG. 3 which is a sectional view taken through the same toggle but with the direction being opposite to that of FIG. 2. The directions for these views are presented with reference to the line 2—2 and 3—3 of FIG. 5.

FIG. 4 is a sectional view generally similar to FIG. 2, but with the toggle element in an alternative position, and this view depicts an alternative embodiment of the present invention wherein a sleeve is provided around the inner shank or shaft portion of the toggle element itself.

FIG. 5 is a sectional view taken generally on the line 5—5 of FIG. 3.

FIG. 6 is a sectional view taken through the shank portion of the toggle element of FIG. 4.

DETAILED DESCRIPTION

Referring now to the drawing in greater detail, there is shown in FIGS. 1, 2, 3 and 5 an electric switch comprising a rectangular case, designated generally at 10, having spaced parallel side walls, and spaced parallel end walls, molded integrally with a bottom portion to provide a floor in which fixed switch contact elements are provided in a conventional fashion, as identified at 12 and 14. The center contact element 14 includes an inner portion **14*a* providing a fulcrum for the movable switch contacting element 16 best shown in FIG. 3. A vertical partition 18 may be provided in the switch case 10, and preferably has a concave upper edge to guide the actuator 28 and to divide the switch case into separate parallel switch compartments. As so constructed and arranged the switch case may be made of nylon, bakelite, or other insulatory material, and may have the electrically conductive fixed contact elements secured in one side in conventional fashion, as shown in FIG. 5**.

The open top of the switch case 10 is covered by a sheet metal cover plate 20 having integrally formed downwardly extending legs **20*a*, the lower ends of which legs are bent inwardly to engage the shoulders defined in the end walls of the switch case 10. This cover plate 20 has a central aperture in which is secured the lower end of an upwardly extending threaded bushing or boss 22 which bushing defines an inwardly extending shoulder adjacent its upper end to provide an arcuately shaped annular bearing seat for the toggle element 24. The lower end of the bushing is rigidly secured to the aperture in the case 20 in accordance with conventional practice. At assembly the toggle element 24 is inserted downwardly through the aperture formed by the upper end of the bushing 22, and a ball shaped collar 26, itself having a central aperture, is staked to the inner shaft portion of the toggle 24. The ball shaped collar 26 abuts the annular shoulder formed at the upper end of the toggle 24 and pivotally engages the bearing inside the boss 22** as taught in my prior U.S. Pat. No. 3,867,604.

The lower end of the toggle shaft is secured to the actuator 28, which actuator is generally rectangular in configuration so as to restrict the motion of it and the toggle to pivotal motion in a plane oriented parallel to the side walls of the switch case 10. The actuator has at least one spring loaded plunger 30, best shown in FIG. 5, adapted to engage the movable contact lever 16 in order to provide at least two positions, or conditions, for the electrical switch itself.

As described up to this point, the switch case shown in the drawing is identical to that illustrated in my prior U.S. Pat. No. 3,867,604. However, in accordance with the present invention, the toggle element 24 and its associated actuator 28 are preferably made of transparent plastic material in order to permit light from a lamp 32 to pass upwardly through the actuator 28 and the toggle 24 in order that the exterior portion of the toggle, best shown in FIG. 1, is illuminated to indicated the condition of the switch. By virtue of the broken line position of the toggle in FIG. 1, the light from this lamp illuminates the toggle with a clear light dictated by the non-colored lamp 32. In the solid line position of FIG. 1 and FIG. 2 the lamp, and the clear plastic toggle 24, and red colored plastic actuator 28, will illuminate the exterior portion of the toggle 24 in FIG. 1 with a red colored light.

Thus, moving toggle 24 to the alternative positions indicated by the broken and solid lines in FIG. 1 will cause light from the lamp source 30 to not strike the actuator 28 but will be restricted to illuminating either strike the inner shaft portion of the toggle element 24 directly with the result that the projecting portion of this toggle will appear as having the color of the lamp source itself or to first pass this light through the red actuator 28, which acts as a window to alter the clear non-colored light from lamp 30 to make the toggle appear red. It will be apparent that the actuator could be any convenient color, and that it functions as window means for imparting to the light from lamp 30 a color to selectively illuminate the projecting portion of the toggle element 24.

When the light source or lamp 30 is not covered by said window means, as suggested for example by the switch condition of FIG. 4, light from the source will illuminate the shaft portion of the toggle and simply illuminate the projecting portion thereof with whatever color the plastic toggle itself is made from in combination with the color (if any) of light eminating from the lamp itself. Still with reference to FIG. 4, the electric switch there shown is of slightly different construction from that of FIGS. 1, 2, 3 and 5 in that the shaft or shank portion of the toggle 24 is fitted with a transparent plastic sleeve 34 with the result that light from the lamp 30 must first pass through this sleeve 34 prior to illuminating the toggle 24, and thereby provides an alternative contrasting color for the projecting portion of the toggle 24 when the lamp is in the alternative position depicted by the broken lines of FIG. 1 for example. The toggle switch construction depicted in FIG. 4, therefor, provides a convenient means for illuminating the toggle or operating lever of the switch with either a red or a green color rather than being restricted to one or the other of these colors and a clear transparent or white color from the lamp as is true of the switch construction depicted in FIGS. 1, 2, 3 and 5. FIG. 6 shows the cross sectional configuration of the inner end of the toggle 24 in FIG. 4.

I claim:

1. An electric switch comprising a case, a cover for the case defining an opening, a transparent plastic operating member with a portion projecting outwardly through said cover opening, annular collar means received on said member and defining a shoulder which bears against the inside of the cover opening to allow pivotal motion of the operating member in at least one plane, fixed and movable switch contact elements provided in the case, at least one light source located in fixed position inside the case remote from said collar shoulder, actuator means mounted on the inner end of said transparent operating lever and including means for engaging said movable contact element in response to pivotal operating lever movement, said actuator means defining light transparent window means movable over said light source when said operating member is in one position for transmitting light to the projecting portion of the operating member in said one position.

2. An electric switch as defined in claim 1 wherein the operating member is fabricated of clear plastic, and wherein said window means has a color contrasting with said clear plastic.

3. An electric switch as set forth in claim 1 wherein said operating member has a second position such that the light source is not covered by the window means of the actuator in said second position, and light from said source in said second position for said operating member being adapted to illuminate a portion of the operating member inside the switch case such that the projecting portion of the operating member transmits the color of the light source and that of the transparent plastic operating member rather than a combination of these plus the color of the window means defined by the actuator, and said window means having a color which contrasts with that of said operating member.

4. An electric switch as defined in claim 1 wherein said transparent plastic operating member is fabricated from clear plastic and said light source providing a substantially white light, said window means having a color which contrasts with the white light from the source when said operating member is in a second position with said window means moved out of said position over the light source, said operating member having a position inside the switch case wherein said window means is illuminated from said source when the operating member is in said second position.

5. An electric switch comprising a case, a cover for the case defining an opening, a transparent plastic operating member with a portion projecting outwardly through said cover opening and having a shoulder which bears against the inside of the cover opening to allow at least pivotal motion of the operating member, fixed and movable switch contact elements provided in the case, at least one light source in the case, actuator means mounted on the inner end of said operating lever and including means for engaging said movable contact element in response to pivotal operating lever movement, said actuator means defining light transparent window means movable over said light source when said operating member is in one position for transmitting light to the projecting portion of the operating member in said one position, said operating member being fabricated of clear plastic and having an intermediate portion inside the switch case, a plastic sleeve for the portion of said operating member inside the switch case, said sleeve being of transparent plastic and having a color which contrasts with that of said window means and also with said clear plastic operating member, whereby the projecting portion of the operating member is illuminated with the color of the window means when in said one position and is illuminated with the color of said sleeve when in said second position.

* * * * *